US009322619B2

(12) United States Patent
Lee et al.

(10) Patent No.: US 9,322,619 B2
(45) Date of Patent: *Apr. 26, 2016

(54) IMPACT MARKING GARMENT

(71) Applicant: Apex Tactical Specialties, Inc., Los Osos, CA (US)

(72) Inventors: Randall M. Lee, Los Osos, CA (US); Jerry L. Jones, Barlow, KY (US)

(73) Assignee: Apex Tactical Specialties, Inc., Los Osos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/622,689

(22) Filed: Feb. 13, 2015

(65) Prior Publication Data

US 2016/0091286 A1 Mar. 31, 2016

Related U.S. Application Data

(63) Continuation of application No. 14/301,212, filed on Jun. 10, 2014, now Pat. No. 8,984,663, which is a continuation of application No. 13/006,419, filed on Jan. 13, 2011, now Pat. No. 8,769,713.

(51) Int. Cl.
*F41H 1/02* (2006.01)

(52) U.S. Cl.
CPC ..... *F41H 1/02* (2013.01)

(58) Field of Classification Search
CPC ..... F41H 1/02; F41H 5/0485; A41D 13/015; A41D 13/018; A41D 13/0518; A63B 71/12; F41J 1/01; F41J 3/0004
USPC ..... 2/2.5, 1, 455, 456, 462, 463, 465; 273/378, 408; 428/911
See application file for complete search history.

(56) References Cited

U.S. PATENT DOCUMENTS

| | | | |
|---|---|---|---|
| 1,093,171 | A | 4/1914 | Buell |
| 1,145,585 | A | 7/1915 | Hebard |
| 3,423,092 | A | 1/1969 | Kandel |
| 3,866,909 | A | 2/1975 | DeSantis |
| 3,895,803 | A | 7/1975 | Loe |
| 3,899,175 | A | 8/1975 | Loe |
| 3,971,072 | A | 7/1976 | Armellino |
| 4,373,733 | A | 2/1983 | Smith, Jr. |
| 4,774,724 | A | 10/1988 | Sacks |
| 5,008,959 | A | 4/1991 | Coppage, Jr. |
| 5,142,309 | A | 8/1992 | Lee |
| 5,186,468 | A | 2/1993 | Davies |
| 5,188,371 | A | 2/1993 | Edwards |
| 5,195,752 | A | 3/1993 | Reeves |
| 5,221,092 | A | 6/1993 | Simons, Jr. |
| 5,275,890 | A | 1/1994 | Wolf |
| 5,501,467 | A | 3/1996 | Kandel |
| 5,580,063 | A | 12/1996 | Edwards |
| 5,636,378 | A | 6/1997 | Griffith |

(Continued)

OTHER PUBLICATIONS

Lee et al; U.S. Appl. No. 14/301,212, filed Jun. 10, 2014.

(Continued)

*Primary Examiner* — Tejash Patel
(74) *Attorney, Agent, or Firm* — Fitch, Even, Tabin & Flannery LLP

(57) ABSTRACT

A method and apparatus for use in facilitating force-on-force (FOF) training. Specifically, an impact marking vest (IMV) for use in registering a ballistic impact event upon a three-dimensional target surface.

20 Claims, 9 Drawing Sheets

(56) References Cited

U.S. PATENT DOCUMENTS

| | | | | |
|---|---|---|---|---|
| 5,669,610 | A | 9/1997 | Salyers | |
| 5,742,939 | A | 4/1998 | Williams | |
| 5,789,327 | A | 8/1998 | Rousseau | |
| 5,797,140 | A | 8/1998 | Davis | |
| 5,845,629 | A | 12/1998 | Ratliff | |
| 5,991,925 | A | 11/1999 | Wu | |
| 6,012,162 | A | 1/2000 | Bullat | |
| 6,131,198 | A | 10/2000 | Westrick | |
| 6,543,775 | B1 | 4/2003 | Bell, Jr. | |
| 7,200,871 | B1 | 4/2007 | Carlson | |
| 7,631,877 | B2 | 12/2009 | Zara | |
| 7,730,548 | B1 | 6/2010 | McCraney | |
| 7,805,767 | B2 | 10/2010 | McElroy | |
| 8,769,713 | B2 | 7/2014 | Lee | |
| 8,984,663 | B2 * | 3/2015 | Lee et al. | 2/2.5 |
| 2002/0133867 | A1 | 9/2002 | Lee | |
| 2007/0046760 | A1 | 3/2007 | Zara | |
| 2007/0079416 | A1 | 4/2007 | Carlson | |
| 2007/0262529 | A1 | 11/2007 | Gamez | |
| 2008/0208488 | A1 | 8/2008 | Yang | |
| 2008/0254907 | A1 | 10/2008 | Swartz | |
| 2009/0064389 | A1 | 3/2009 | Putman | |
| 2010/0083428 | A1 | 4/2010 | McElroy | |
| 2010/0154092 | A1 | 6/2010 | McCraney | |
| 2010/0218695 | A1 | 9/2010 | Kirkpatrick | |
| 2011/0185464 | A1 | 8/2011 | Weber | |
| 2011/0209259 | A1 | 9/2011 | Chu | |
| 2012/0198593 | A1 | 8/2012 | Beck | |

OTHER PUBLICATIONS

Lee et al; U.S. Appl. No. 13/006,419, filed Jan. 13, 2011.

Non Final Office Action for U.S. Appl. No. 13/006,419 mailed Apr. 5, 2013.

Non Final Office Action for U.S. Appl. No. 13/006,419 mailed Jul. 3, 2012.

Notice of Allowance for U.S. Appl. No. 13/006,419 mailed Feb. 27, 2014.

Non Final Office Action for U.S. Appl. No. 14/301,212 mailed Jul. 30, 2014.

Notice of allowance from U.S. Appl. No. 14/301,212 mailed Nov. 7, 2014.

Supplemental Notice of Allowance from U.S. Appl. No. 14/301,212 mailed Dec. 23, 2014.

Preliminary Notice of Reasons for Rejection for Japanese Patent Application No. 2012-004246 mailed Dec. 1, 2015 by the Japan Patent Office (9419-95631- JP).

* cited by examiner

IMPACT MARKING GARMENT

This application is a continuation of application Ser. No. 14/301,212 filed Jun. 10, 2014, entitled IMPACT MARKING GARMENT, which is a continuation of application Ser. No. 13/006,419 filed Jan. 13, 2011, now U.S. Pat. No. 8,769,713, issued Jul. 8, 2014, entitled IMPACT MARKING VEST, all of which are fully incorporated herein by reference.

FIELD OF INVENTION

This invention relates to an apparatus for indicating the point of impact of a projectile fired from a non-lethal firearm. In particular, this invention relates to an addition to a traditional ballistics vest that will aid in true impact and directional assessment allowing for improved instruction during simulated force-on-force ballistics training.

BACKGROUND OF THE INVENTION

Over the past decade, force-on-force (FOF), or reality based lethal force simulation training, has become established within the Law Enforcement and Military communities as an essential training method. Generally, FOF training involves role playing participants that are armed with non-lethal marking or replica type firearms that fire 6 mm or 8 mm plastic projectiles. During the course of training, participants' reactions and tactics are analyzed and reviewed in order to better train the participants to function in a heightened adrenaline state and survive a potentially lethal confrontation.

Typically FOF training simulations require equipment consisting of two basic types: firearms modified to fire paint filled marking cartridges; or, replicas shooting plastic spheres (BBs) commonly referred to as "Airsoft" guns.

BRIEF SUMMARY OF THE INVENTION

Several embodiments of the present invention answer the above and other needs by providing an Impact Marking Vest (IMV) system for use in indicating the position and angle of an impact on a ballistic vest.

In one embodiment, the invention may be characterized as an impact marking vest comprising: a backing layer comprising a flexible material for forming a three-dimensional (3D) target surface; a substrate layer bonded to the backing layer such that the substrate layer covers at least a portion of an exterior surface of the backing layer, wherein the substrate layer comprises a first color; a coating layer disposed on the substrate layer and covering substantially an entire exterior surface of the substrate layer, wherein the coating layer is a second color different from the first color of the substrate layer; and an attachment device connected to the backing layer and configured for attachment to a ballistic vest.

In another embodiment, the invention may be characterized as a method of forming a ballistic impact marking vest comprising the steps of: forming a backing layer comprising a flexible material into a three-dimensional (3D) target surface; bonding a substrate layer to the backing layer such that the substrate layer covers at least a portion of an exterior surface of the backing layer, wherein the substrate layer comprises a first color; disposing a coating layer on the substrate layer such that the coating layer substantially covers an exterior surface area of the substrate layer, wherein the coating layer is a second color, different from the first color of the substrate layer; and fixing an attachment device to the backing layer, wherein the attachment device is configured for attachment to a ballistic vest.

DETAILED DESCRIPTION

The following description is not to be taken in a limiting sense, but is made merely for the purpose of describing the general principles of exemplary embodiments. The scope of the invention should be determined with reference to the claims.

Widely acknowledged drawbacks to marking cartridge systems include the high per-round unit cost of marking cartridge ammunition as well as the increased need for enhanced safety protocols. For example, modified firearms pose the risk that some participants may convert live firearms to function with marking cartridge ammunition, increasing the probability that live ammunition and fully functioning firearms will be introduced into the training environment. Although, the use of Airsoft guns and plastic BBs serves to mitigate the cost of simulation training, plastic BBs fail to provide the marking indications necessary for the verification of impact or impact angles on a role player.

Figure 1:
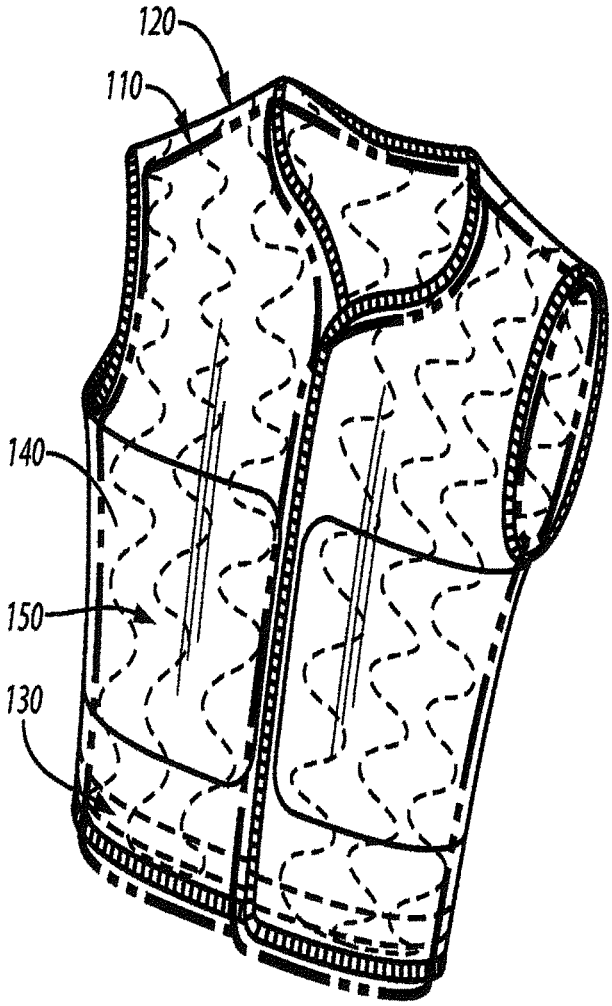
FIG. 1 is a perspective view of an impact marking vest cooperated together with a ballistic vest according to one embodiment of the present invention.

Referring now to FIG. 1, which depicts a ballistic vest 110 together with the impact marking vest (IMV) 120 comprising attachment device 130, coating layer 140 and a target surface formed from a substrate layer 150.

In one embodiment, the ballistic vest 110 is a protective vest system that may function as a ballistic vest, overlying the body of a user. In a preferred embodiment, the ballistic vest 110 is configured to overlay the upper body or torso region of a user and will contain holes for the user's arms, neck and torso. However, in alternative embodiments, the ballistic vest 110 may be shaped or configured to cover essentially any portion of a user's body. To facilitate cooperation with a user's body, the ballistic vest 110 may include one or more fastening devices. By way of example, the ballistic vest 110 may include fastening means such as, but not limited to: straps, elastic straps, fasteners, zippers, buttons, magnetic means, adhesive means or a hook and loop type fastening device, such as VELCRO or a functional equivalent, etc. The ballistic vest 110 may also be constructed of one or more layers; however, in preferred embodiments, the ballistic vest 110 will be comprised of a flexible and impact resistant material. By way of example, the ballistic vest 110 may be comprised of free-floating layers of plastic or Kevlar, nylon or cotton fabric.

In one preferred embodiment, the impact marking vest (IMV) 120 is mechanically cooperated with ballistic vest 110 via attachment device 130 such that the IMV 120 substantially covers the entire outside surface of the ballistic vest 110. In this configuration, the torso of a user wearing the ballistic vest 110 together with the IMV 120 will be covered by the IMV 120 over substantially the same areas as if the ballistic vest 110 were to be worn alone. In one preferred embodiment, the attachment device 130 used to fasten the IMV 120 to the ballistic vest 110 comprises a hook and loop type fastening device, such as VELCRO or a functional equivalent. However, cooperation between the IMV 120 and ballistic vest 110 can be accomplished using virtually any suitable fastening means, including but not limited to: straps, elastic straps, fasteners, zippers, buttons, magnetic means, adhesive means or a hook and loop type fastening device, such as VELCRO or a functional equivalent, etc.

In an alternative embodiment, the IMV 120 may be mechanically cooperated with the ballistic vest 110 via a carrying device (not shown) such as a wire frame or a ballistic nylon holder. In this embodiment, the IMV 120 may cooperate with the carrying device such that at least a portion of the IMV 120 is exposed on the outer surface. Regardless of whether the IMV 120 is worn together with the ballistic vest 110 or worn alone, the outer surface of the IMV 120 effectively forms a three-dimensional (3D) target face.

In yet another embodiment, the IMV 120 may be worn without the use of the ballistic vest 110 altogether. For example, the IMV 120 may be worn alone or may be worn over the user's clothing. In some embodiments, the attachment device 130 may be configured to cooperate with, or adhere to an article of the user's clothing. In other embodiments, the attachment device 130 may be configured to cooperate with a portion of the user's body such that mechanical cooperation with clothing or the ballistic vest 110 is unnecessary for effective use of the IMV 120.

As will be described in further detail below, the IMV 120 is comprised of a coating layer 140 disposed on top of an underlying substrate layer 150 such that a target design is formed by the regions of the substrate layer 150 not obscured by coating layer 140 (by exposed regions of the substrate layer 150). In one embodiment, the substrate layer 150 may be comprised of a paper or plastic material. In alternative embodiments the substrate layer may be comprised of a plastic film; however, the substrate layer may be comprised of essentially any material suitable for indicating a contrast between the substrate layer 150 and the coating layer 140.

In some embodiments, the coating layer 140 may completely cover the substrate layer 150 such that the underlying substrate layer 150 is not immediately visible and no target pattern is discernable. Alternatively, the target design may be in or on the coating layer 140, or in or on the substrate layer 150 (and either obscured by the coating layer 140 or aligned with regions of the substrate layer 150 not obscured by the coating layer 140). The target pattern may include a concentric circle pattern (i.e., a target design) or may indicate more highly valuable target locations, such as regions where a target may be more exposed, and not protected by his/her ballistic vest, such as at the armpits.

In operation, a user wearing the cooperated ballistic vest 110 and IMV 120 combination will be effectively covered by the IMV 120 outer surface. Accordingly, when used in conjunction with simulated training firearms, the coating layer 140 disposed on the outer surface of IMV 120 will flake away upon ballistic impact, exposing the underlying substrate layer 150. In a preferred embodiment, the coating layer 140 will be of a dark color or pigment in order to contrast with a brightly colored substrate layer 150 such that the direction and point of impact on the IMV 120 will be easily ascertainable by an observer. In some embodiments, the coating layer 140 may be of a black, matte-black, matte-olive drab or earth tone color and substrate layer 150 may be a bright orange, yellow or green color. However, the coloration of coating layer 140 and substrate layer 150 may be of any combination that provides a visible contrast between the substrate layer 150 and coating layer 140. Alternatively, this contrast may be invisible in the visible spectrum, but detectable in, e.g., the infrared spectrum, or under a source of irradiation selected to cause, e.g., fluorescence, e.g., of the exposed substrate layer 150, and not of the coating layer 140.

In a preferred embodiment, the IMV 120 will be used in conjunction with a non-lethal marking firearm or replica firearm (e.g., an "Airsoft" gun) that fires 6 mm or 8 mm plastic BBs. However, the IMV 120 may conceivably be used with any firearm/firearm replica or projectile suitable to cause the removal of the coating layer 140 on the outer surface of the IMV 120.

Figure 2:
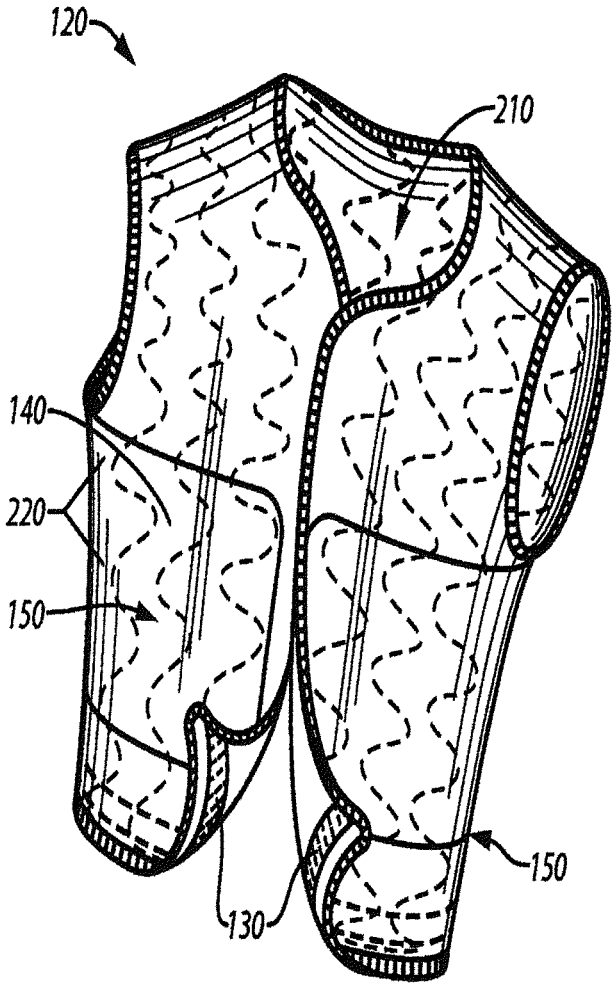
FIG. 2 is a perspective view of the impact marking vest of FIG. 1.

Referring now to FIG. 2, which depicts a more detailed perspective view of the IMV 120 comprising attachment device 130, a coating layer 140, a backing layer 210 and a target surface 220 formed from the substrate layer 150.

In one preferred embodiment, the backing layer 210 is configured in a three-dimensional vest shape and forms the inner surface of IMV 120. For example, the backing layer 210 may be comprised of thin-film high density foam for conforming to the curvature of a user's body. In alternative embodiments the backing layer may comprise substantially any suitably flexible and/or rigid material. However, in preferred embodiments, the backing layer 210 will be constructed of a semi-penetrable material that will facilitate the flaking away of the coating layer 140, as will be further discussed below.

In operation, the substrate layer 150 is disposed on the backing layer 210, using an adhesive coating (as will be described in further detail below), such that the substrate layer 150 covers either all or a portion of the outer surface of the backing layer 210. The outer surface of the substrate layer 150 is then covered with the coating layer 140 such that a target surface 220 is defined by the visible (or, as noted above, otherwise distinguishable) portion of the substrate layer 150 that is revealed by the absence of the coating layer 140. In alternative embodiments, the coating layer 140 may cover the entire outer surface of substrate layer 150 or may cover any fractional portion thereof to form substantially any desired pattern or design. The attachment device 130 is then fixed to the backing layer 210 and configured for attachment to a ballistic vest 110 such as that shown in FIG. 1, above.

Figure 3:
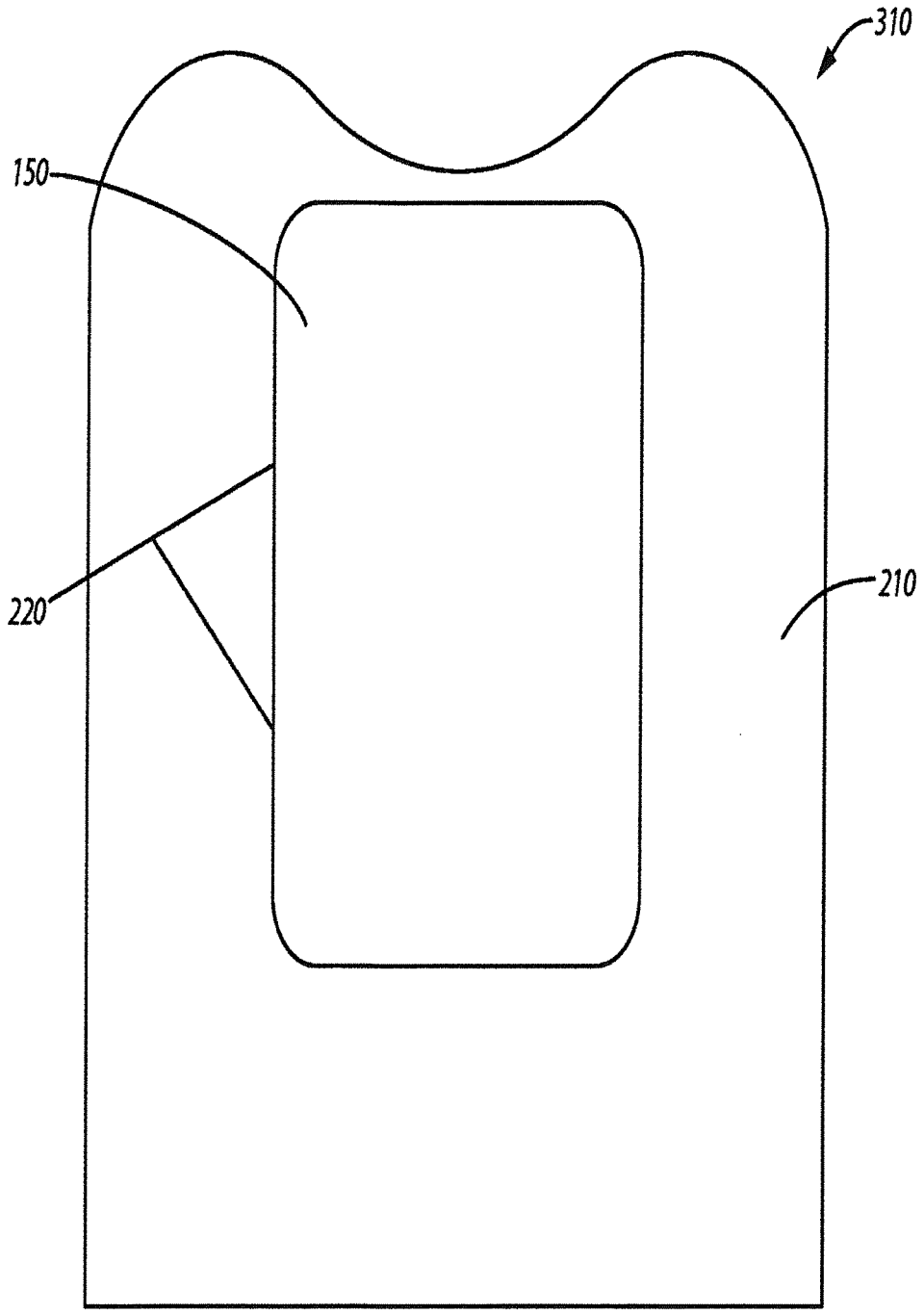
FIG. 3 is a schematic view of a back panel used in forming the impact marking vest comprised of a backing layer, a substrate layer and a target surface formed from the substrate layer.

Referring now to FIG. 3, which depicts a 2D schematic view of a back panel 310 of the IMV 120 together with the substrate layer 150 forming the target surface 220. In one preferred embodiment, the substrate layer 150 is configured such that the resulting target surface 220 only covers a portion of the back panel 310. However, in alternative embodiments, the substrate layer 150 may be sized such that the resulting target surface 220 covers substantially any desired portion of the surface area of back panel 310.

Figure 4:
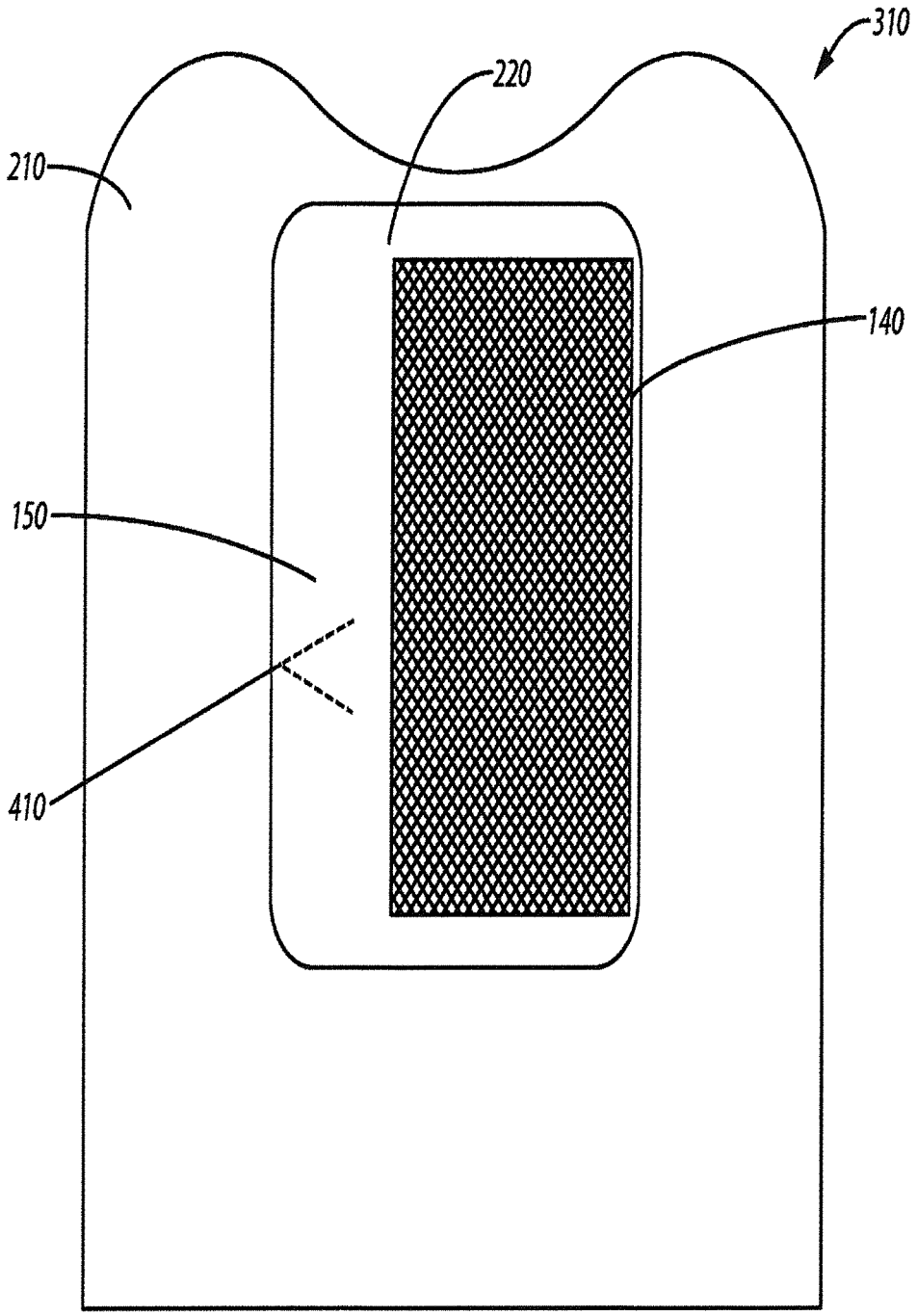
FIG. 4 depicts the back panel of FIG. 3, together with the backing layer, the substrate layer, a target surface, an adhesive coating and a coating layer.

Referring now to FIG. 4, which depicts a 2D cut-away view of the back panel 310 of the IMV 120. The back panel 310 comprising the backing layer 210, the substrate layer 150, the adhesive coating 410 and coating layer 140. In a preferred embodiment the adhesive coating 410 is comprised of a pressure-sensitive adhesive. In some embodiments, the adhesive coating 410 is disposed on the surface of the substrate layer opposite the coating layer 140 such that the substrate layer 150 can be removably attached to the backing layer 210. In an alternative embodiment, the adhesive coating 410 can be disposed on the outer surface of the backing layer 210 to achieve the similar purpose of removably attaching the substrate layer 150.

In practice, the adhesive coating 410 enables the convenient replacement of portions of the substrate layer 150 attached to the backing layer 210. This feature allows a user to readily change/replace the outer surface of the IMV 120 such that used or worn portions of the substrate layer 150 may be easily exchanged with the new substrate layer 150 portions containing the newer coating layer 140.

Figure 5:
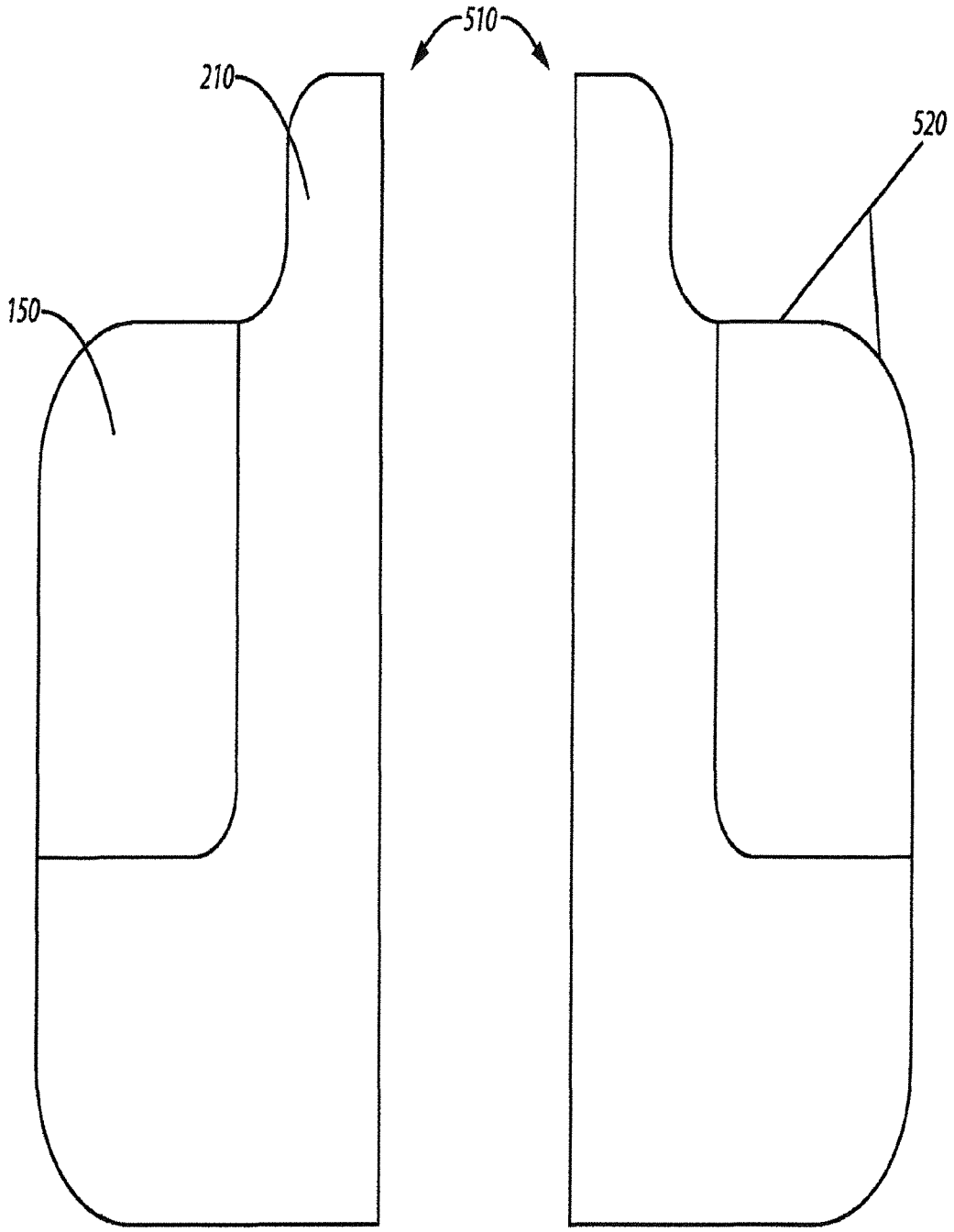
FIG. 5 depicts a schematic view of side panels used in forming the impact marking vest comprising a backing layer, a substrate layer and a target surface formed from the substrate layer.

Referring now to FIG. 5, which depicts a schematic view of the side panels 510 together with a target surface 520 defined by the substrate layer 150. The side panels 510 form the side and front segments of the IMV 120.

In one preferred embodiment, when the IMV 120 is cooperated with the ballistic vest 110 the target surface 520 depicted in FIG. 5 will be configured to wrap around the user's torso covering the underarm and chest portions of the ballistic vest 110. This particular positioning of target surface 520 may facilitate in instructing a FOF participant to avoid exposure of the underarm and chest regions when engaged in a real or simulated firefight. In alternative embodiments, the substrate layer 150 may be configured to create a target surface 520 in essentially any desired position or arrangement with respect to the outer surface of the IMV 120.

Figure 6:
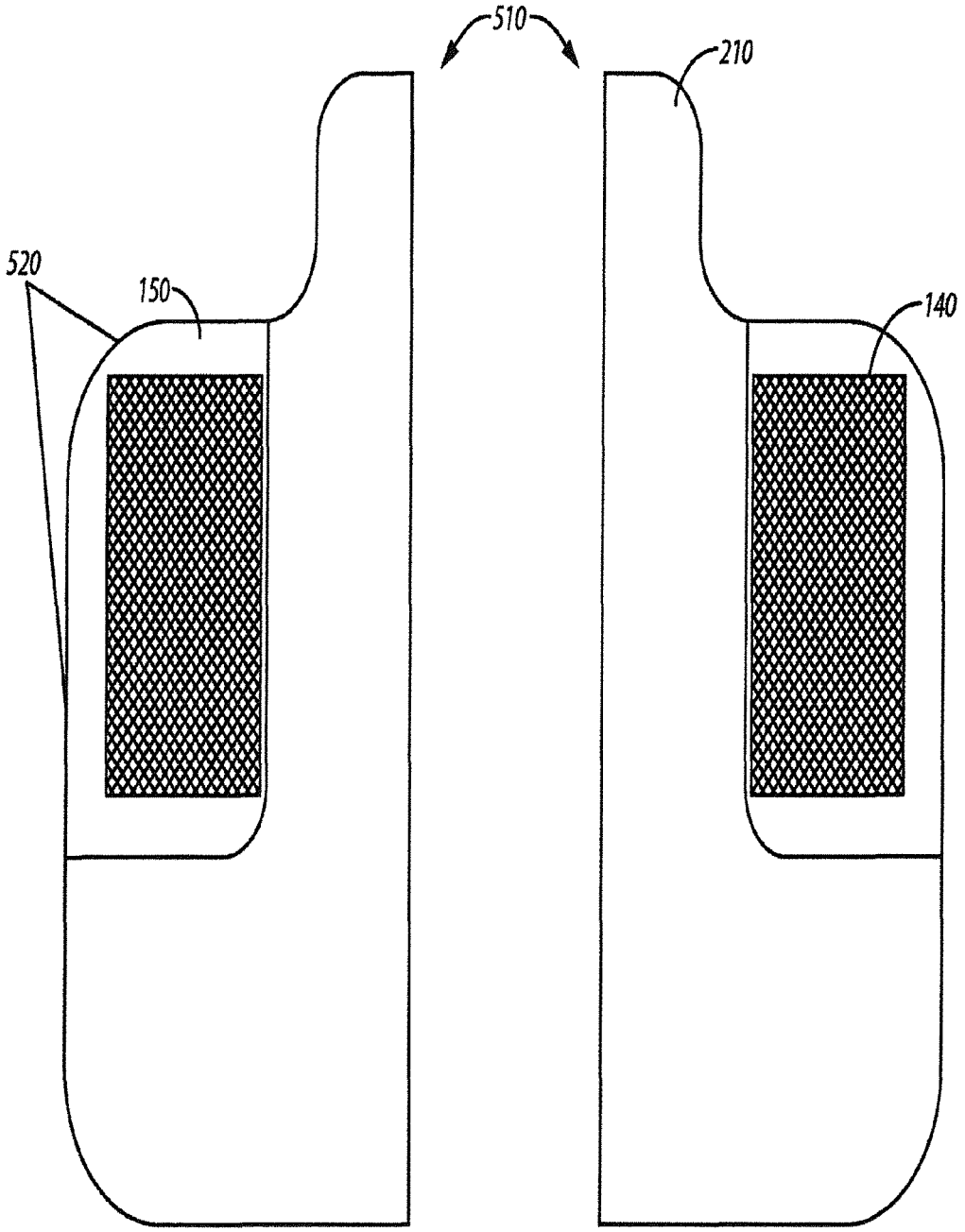
FIG. 6 depicts a schematic view of the side panels of FIG. 5, together with the backing layer, the substrate layer, the target surface formed from the substrate layer and a coating layer.

Referring now to FIG. 6, which depicts the side panels of FIG. 5 together with coating layer 140, backing layer 210 and substrate layer 150 for forming target surface 520. In a preferred embodiment, the coating layer 140 covers only a portion of the substrate layer 150 such that a strip of the underlying substrate layer 150 is revealed by the region wherein the coating layer 140 is absent. This revealed portion of the substrate layer 150 defines the border of the target surface 520 that can be visibly identified on the outer surface of IMV 120. However, although the border of the target surface 520 may be visually identifiable, the majority of the target surface 520 remains obscured by the coating layer 140. In alternative embodiments, the coating layer 140 may cover substantially the entire surface of the substrate layer 150 such that the underlying target surface 520 is wholly obscured.

In practice, the side panels 510 are configured to form the side portions of IMV 120. In such a configuration, the target surface 520 will form a three-dimensional (3D) surface spanning a region from beneath the participant's arms to the center chest portion of the IMV 120. In alternative embodiments, the target surface may be located on substantially any portion of the IMV 120 and may cover the entire outer surface area of the IMV 120, or any portion thereof.

Figure 7:
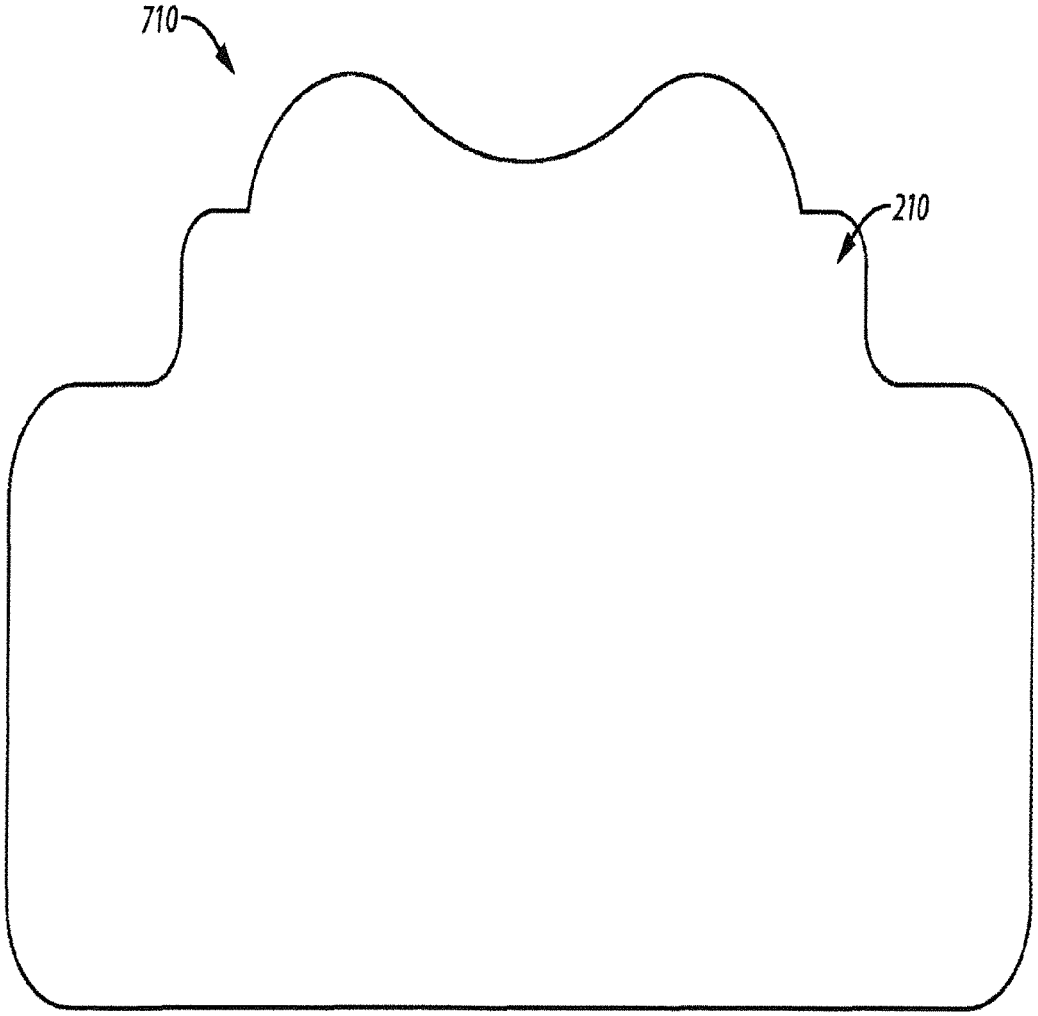
FIG. 7 depicts a two-dimensional schematic view of the complete panel used in forming the impact marking vest.

Referring now to FIG. 7, which depicts a schematic (2D) view of a complete panel 710 comprising the backing layer 210. In practice, the backing layer 210 of the complete panel 710 is molded into a three-dimensional vest shape for use in forming the IMV 120, as described above with respect to FIGS. 1 and 2. However, in alternative embodiments the backing layer 210 may be configured to form essentially any shape to produce a 2D or 3D target surface for use in registering an impact event.

Figure 8:
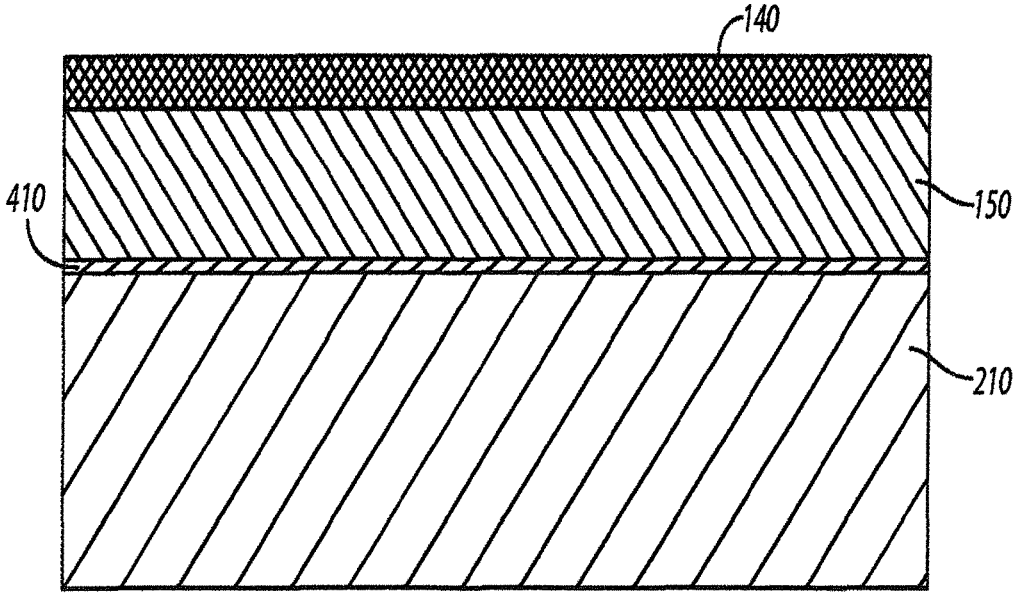
FIG. 8 depicts a cross-sectional view of the layers composing the impact marking vest, including the coating layer, substrate layer and backing layer.

Referring now to FIG. 8, which depicts a cross-sectional view of the IMV 120 comprising the coating layer 140, the substrate layer 150, the adhesive coating 410 and the backing layer 210. In one embodiment, the structure of the IMV 120 is formed by the bonded coating layer 140, the substrate layer 150 and the backing layer 210 as shown in FIG. 8. In one preferred embodiment, the adhesive coating 410 is permanently fixed to the backing layer 210 such that an adhesive surface is formed on the outer surface of the backing layer 210. In this configuration, the substrate layer 150 can be removably bonded with the backing layer 210 via the adhesive surface of the adhesive coating 410. In an alternative embodiment, the adhesive coating 410 can be permanently disposed on the underside of the substrate layer 150, opposite the coating layer 140.

In practice, the coating layer 140 is configured to flake away upon ballistic impact, exposing the underlying substrate layer 150. In one preferred embodiment, the substrate layer 150 is composed of a bright color (e.g. a bright orange or yellow color) that can be easily contrasted with a darker color of the coating layer (e.g. a black, matte-black, matte-olive drab or earth tone color). However, the coating layer 140 and the substrate layer 150 may be comprised of virtually any materials that are distinguishable from one another (visibly or otherwise). With this contrasting color scheme, a user may visually identify a point or angle of ballistic impact by identifying the location on the IMV 120 surface where the coating layer 140 has flaked away to expose the underlying substrate layer 150.

After a ballistic impact has been incurred by the IMV 120, it may be desirable to renew the coating layer 140 on the outer surface of the IMV 120. In a preferred embodiment, the new coating layer 140 may be added to the IMV 120 by simply replacing the underlying substrate layer 150 with a new substrate layer containing the new coating layer 140. In one embodiment, the substrate layer 150 comprises the adhesive coating 410 disposed on the side opposite of the coating layer 140. In this configuration, the substrate layer 150 may be removably attached to the backing layer 210 such that a user may peel away the used substrate layer 150 and the adhesive coating 410 for easy replacement.

Figure 9:
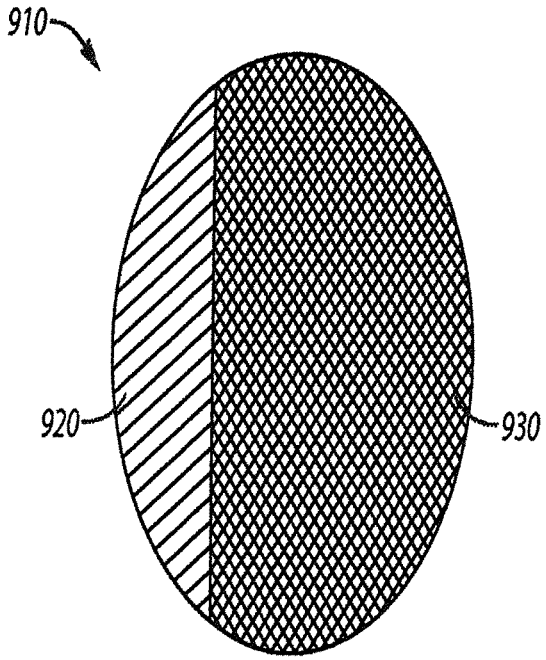
FIG. 9 depicts a coating layer patch comprising an adhesive patch coating and a coating patch layer.

Referring now to FIG. 9, which depicts a cut-away view of a coating layer patch 910 comprising coating patch layer 930 and adhesive patch coating 920. The coating patch layer 930 of the coating layer patch 910 is similar to the coating layer 140 discussed above with respect to the IMV 120. The coating layer patch 910 comprises the coating patch layer 930 on one surface and an adhesive patch coating 920 on the opposite surface. In a preferred embodiment, the coating layer patch will be of a circular shape measuring approximately one-inch in diameter; however, in alternative embodiments the coating layer patch may be of substantially any shape or size.

In practice, the coating layer patch 910 may be used to touch-up the coating layer 140 of the IMV 120. For example, the coating layer patch 910 may be used to cover portions of the coating layer 140 on the IMV 120 that have flaked away due to ballistic impact. As such, the coating layer patch 910 offers a quick and inexpensive way to repair the outer surface of the IMV 120 without the need for replacing the entire the substrate layer 150.

While the above is a complete description of the preferred embodiment of the present invention, it is possible to use various alternatives, modifications and equivalents. Therefore, the scope of the present invention should be determined not with reference to the above description but should, instead be determined with reference to the appended claims, along with their full scope of equivalents. Any feature described herein, whether preferred or not, may be combined with any other feature described herein, whether preferred or not.

What is claimed is:

1. An impact marking garment comprising:

a backing layer comprising a flexible material for forming a target surface shaped to cover a portion of a body of a user;

a substrate layer bonded to the backing layer using an adhesive coating interposed between the backing layer and the substrate layer such that the substrate layer covers at least a portion of an exterior surface of the backing layer, wherein the substrate layer comprises a first color and is configured to not be removed at a point of ballistic impact; and a coating layer disposed on the substrate layer, wherein the coating layer is a second color different from the first color of the substrate layer and covers at least a portion of an exterior surface of the substrate layer.

2. The impact marking garment of claim 1, further comprising an attachment device connected to the backing layer and configured for attachment to an underlying garment.

3. The impact marking garment of claim 2, wherein the underlying garment is a ballistic vest.

4. The impact marking garment of claim 3, wherein the backing layer is shaped to conform to an outer surface of the ballistic vest.

5. The impact marking garment of claim 1, wherein the substrate layer forms a target design.

6. The impact marking garment of claim 1, wherein the coating layer is a flake away coating.

7. The impact marking garment of claim 6, wherein the coating layer is further configured to flake away exposing the substrate layer at a point of ballistic impact.

8. The impact marking garment of claim 1, wherein the first color is a dark color and the second color is a bright color providing a visible contrast with the first color.

9. The impact marking garment of claim 1, wherein the adhesive coating is comprised of a pressure-sensitive adhesive.

10. The impact marking garment of claim 1, wherein the adhesive coating is disposed on a surface of the substrate layer opposite the coating layer.

11. The impact marking garment of claim 1, wherein the adhesive coating is disposed on an outer surface of the backing layer.

12. The impact marking garment of claim 1, wherein the adhesive coating is configured for removable attachment of the substrate layer.

13. The impact marking garment of claim 1, further comprising a coating patch including a coating patch layer and an adhesive patch coating on one surface of the coating patch layer, wherein the coating patch is disposed on the impact marking garment using the adhesive patch coating such that the coating patch covers a portion of the impact marking garment where a portion of the coating layer has been removed due to ballistic impact.

14. A method of replacing a substrate layer of an impact marking garment, comprising the steps of:

removably attaching a first substrate layer to a backing layer of the impact marking garment, the backing layer comprising a flexible material for forming a target surface shaped to cover a portion of a body of a user, the first substrate layer covering at least a portion of an exterior surface of the backing layer, wherein the first substrate layer is configured to not be removed at a point of ballistic impact, and wherein a first coating layer is disposed on at least a portion of an exterior surface of the first substrate layer;

removing the first substrate layer from the backing layer;

removably attaching a second substrate layer to the backing layer, the second substrate layer covering at least the portion of the exterior surface of the backing layer, wherein the second substrate layer is configured to not be removed at the point of ballistic impact, and wherein a second coating layer is disposed on at least a portion of an exterior surface of the second substrate layer.

15. The method of replacing the substrate layer of an impact marking garment of claim 14, whereby at least one of the first substrate layer and the second substrate layer includes an adhesive coating permanently disposed on a surface of the substrate layer opposite the coating layer, the adhesive coating configured for removable attachment to the backing layer.

16. A method of repairing an outer surface of an impact marking garment, comprising the steps of:

providing the impact marking garment comprising a backing layer comprising:

a flexible material for forming a target surface shaped to cover a portion of a body of a user;

a substrate layer bonded to the backing layer such that the substrate layer covers at least a portion of an exterior surface of the backing layer, wherein the substrate layer comprises a first color and is configured to not be removed at a point of ballistic impact; and a coating layer disposed on the substrate layer, wherein the coating layer is a second color different from the first color of the substrate layer and covers at least a portion of an exterior surface of the substrate layer; and adhering a coating patch to the substrate layer, the coating patch covering a portion of the substrate layer, the coating patch comprising a coating patch layer and an adhesive patch coating on one surface of the coating layer.

17. The method of repairing the outer surface of the impact marking garment of claim 16, wherein the coating patch covers a portion of the substrate layer where a ballistic impact has removed a portion of the coating layer.

18. The method of repairing the outer surface of the impact marking garment of claim 16, wherein the coating patch is circular.

19. The method of repairing the outer surface of the impact marking garment of claim 18, wherein the coating patch is approximately one inch in diameter.

20. The method of repairing the outer surface of the impact marking garment of claim 16, where a coating patch color is the second color.

* * * * *